US007033291B1

(12) United States Patent
Meeker

(10) Patent No.: US 7,033,291 B1
(45) **Date of Patent: *Apr. 25, 2006**

(54) POLYMER SHELL BAT

(75) Inventor: Ricky Meeker, Tullahmoa, TN (US)

(73) Assignee: Worth, LLC, Tullahoma, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/111,271

(22) Filed: Apr. 21, 2005

Related U.S. Application Data

(63) Continuation-in-part of application No. 10/212,405, filed on Aug. 5, 2002, now Pat. No. 6,969,330.

(60) Provisional application No. 60/317,813, filed on Sep. 6, 2001.

(51) Int. Cl.
*A63B 59/06* (2006.01)

(52) U.S. Cl. ..... 473/567; 473/566

(58) Field of Classification Search ..... 473/564–568, 473/457, 519, 520
See application file for complete search history.

(56) References Cited

U.S. PATENT DOCUMENTS

| | | | | | |
|---|---|---|---|---|---|
| 3,921,978 | A | * | 11/1975 | Warren | 473/567 |
| 4,505,479 | A | * | 3/1985 | Souders | 473/566 |
| 4,546,976 | A | * | 10/1985 | Jones | 473/566 |
| 4,569,521 | A | * | 2/1986 | Mueller | 473/520 |
| 4,644,630 | A | * | 2/1987 | Blum | 29/453 |
| 5,303,917 | A | * | 4/1994 | Uke | 473/567 |
| 5,364,095 | A | | 11/1994 | Easton | 473/566 |
| 5,458,330 | A | * | 10/1995 | Baum | 473/567 |
| 5,722,908 | A | | 3/1998 | Feeney et al. | 473/567 |
| 5,906,550 | A | | 5/1999 | Kingston | 473/320 |
| 5,928,090 | A | | 7/1999 | Cabales et al. | 473/318 |
| 5,964,673 | A | | 10/1999 | MacKay, Jr. | 473/566 |
| 6,007,439 | A | | 12/1999 | MacKay, Jr. | 473/520 |
| 6,022,282 | A | | 2/2000 | Kennedy et al. | 473/567 |
| 6,036,610 | A | | 3/2000 | Lewark | 473/564 |
| 6,042,493 | A | | 3/2000 | Chauvin et al. | 473/566 |
| 6,053,827 | A | | 4/2000 | MacKay, Jr. et al. | 473/566 |
| 6,053,828 | A | * | 4/2000 | Pitsenberger | 473/566 |
| 6,056,655 | A | | 5/2000 | Feeney et al. | 473/567 |
| 6,139,451 | A | | 10/2000 | Hillerich, III et al. | 473/564 |
| 6,143,429 | A | | 11/2000 | Abkowitz et al. | 428/651 |
| 6,146,291 | A | | 11/2000 | Nydigger | 473/566 |
| 6,148,826 | A | | 11/2000 | Lancaster et al. | 131/191 |
| 6,152,840 | A | | 11/2000 | Baum | 473/564 |
| 6,176,795 | B1 | | 1/2001 | Schullstrom | 473/566 |
| 6,425,836 | B1 | * | 7/2002 | Misono et al. | 473/567 |
| 6,461,260 | B1 | * | 10/2002 | Higginbotham | 473/566 |

FOREIGN PATENT DOCUMENTS

JP SHO51-13165 * 4/1976

* cited by examiner

*Primary Examiner*—Mark S. Graham
(74) *Attorney, Agent, or Firm*—Waddey & Patterson, P.C.; Phillip E. Walker; Edward D. Lanquist, Jr.

(57) ABSTRACT

A metal baseball or softball bat may be improved both for durability and performance by selectively placing a layer of polymer material around portions of the bat. In one embodiment, the barrel portion of the bat may have a polymer layer directly laid up upon the metal bat frame. In a second embodiment, the barrel portion of the bat may include an outer metal sleeve placed about the metal bat frame, with an exterior polymer shell being formed on the outer metal sleeve. In a third embodiment, an intermediate portion of the bat adjacent a zone of maximum bending stress may be reinforced by the placement of a polymer outer layer on the metal frame of the bat adjacent the area of maximum bending stress.

16 Claims, 5 Drawing Sheets

POLYMER SHELL BAT

This application is a continuation-in-part of U.S. application Ser. No. 10/212,405, filed Aug. 5, 2002 now U.S. Pat. No. 6,969,330 and entitled "Polymer Shell Bat", which claims priority to U.S. Application No. 60/317,813, filed Sep. 6, 2001, wherein both applications are hereby incorporated by reference in their entireties.

BACKGROUND OF THE INVENTION

This invention relates generally to a bat for the diamond sports and more particularly to a bat have a polymer shell. The present invention is directed generally to ball bats and more, particularly to an enhanced ball bat using a polymer shell. This bat uses an aluminum frame with a polymer shell formed around the aluminum frame. This invention is not limited to only an improvement in the hitting area of the bat, but can provide enhanced characteristics by using varying amount of coverage from a partial coverage to full coverage of the aluminum frame.

Proof of concept prototypes for both fast pitch and slow pitch models have been constructed and work exceptionally well. The fast pitch model consists of an aluminum frame and a polymer shell only. The slow pitch model consists of an aluminum frame, an aluminum shell, and a polymer shell on top of the aluminum shell. The polymer bat drawings included with this description provide a visual description of the present invention and show the general tolerances and construction for a polymer shell bat.

Softball and baseball are very popular sports. The technology used in diamond sports bats has exploded. The need for high performance bats has caused bats to become more and more expensive. It will be appreciated by one of ordinary skill in the art that bats must be capable of meeting the needs for high performance. Bats must be capable of being durable and perform well. To this end there have been several attempts to improve the performance of bats.

Several United States patents discuss sporting equipment using shafts or varying materials and their technologies including: U.S. Pat. No. 5,722,908, issued to Feeney et al. on Mar. 3, 1998, entitled Composite Bat With Metal Barrel Area and Method of Fabrication; U.S. Pat. No. 5,906,550 issued to Kingston on May 25, 1999, entitled Sports Bat Having MultiLayered Shell; U.S. Pat. No. 5,364,095 issued to Easton on Nov. 15, 1994 entitled Tubular Metal Bat Internally Reinforced With Fiber Composite; U.S. Pat. No. 5,928,090, issued to Cabales, et al., on Jul. 27, 1999, entitled Golf Shaft For Controlling Passive Vibrations; U.S. Pat. No. 5,964,673 issued to MacKay, Jr., on Oct. 12, 1999, entitled Hollow Metal Bat With Stiffened Transition Zone and Method of Making Same; U.S. Pat. No. 6,007,439 issued to MacKay, Jr., on Dec. 28, 1999, entitled Vibration Dampener For Metal Ball Bats and Similar Impact Implements; U.S. Pat. No. 6,022,282 issued to Kennedy, et al., on Feb. 8, 2000, entitled Ball Bat With Tailored Flexibility; U.S. Pat. No. 6,036,610 issued to Lewark on Mar. 14, 2000, entitled Reinforced Baseball Bat; U.S. Pat. No. 6,042,493 issued to Chauvin et al., on Mar. 28, 2000, entitled Tubular Metal Bat Internally Reinforced With Fiber and Metallic Composite; U.S. Pat. No. 6,053,827 issued to MacKay, Jr., et al. on Apr. 25, 2000, entitled Metal Bat With Pressurized Bladder In Hitting Zone and Method of Making Same; U.S. Pat. No. 6,053,828, issued to Pitsenberger on Apr. 25, 2000, entitled Softball Bat With Exterior Shell; U.S. Pat. No. 6,056,655 issued to Feeney, et al., on May 2, 2000, entitled Composite Bat With Metal Barrel Area and Method of Fabrication; U.S. Pat. No. 6,139,451 issued to Hillerich, III, et al., on Oct. 31, 2000, entitled Reinforced Wood Bat; U.S. Pat. No. 6,143,429 issued to Abkowitz, et al., on Nov. 7, 2000, entitled Titanium/Aluminum Composite Bat; U.S. Pat. No. 6,146,291 issued to Nydigger on Nov. 14, 2000, entitled Baseball Bat Having a Tunable Shaft; U.S. Pat. No. 6,148,826 issued to Lancaster, et al., on Nov. 21, 2000, entitled Glass Bat; U.S. Pat. No. 6,152,840 issued to Baum on Nov. 28, 2000, entitled Composite Baseball Bat With Cavitied Core; and U.S. Pat. No. 6,176,795 issued to Schullstrom on Jan. 23, 2001, entitled Aluminum Bat With Improved Core Insert. Each of these United States patents is hereby incorporated by reference.

Prior art bats have attempted to improve the durability of bats through thickening and/or strengthening the barrel section while leaving the handle and taper sections as light and bendable as possible. While the momentum of the bat provides most of the force to the ball in swinging a bat, bat bending or diving board effect also provides force upon the ball. Additionally, the hoop forces or trampoline effect also act on the ball.

What is needed then is a bat that performs better. This needed bat must have a strong and durable barrel. This needed bat must provide additional trampoline effect while not lowering the diving board effect. This needed bat must be easily and inexpensively manufactured. This needed bat must have the ability to be finished and decorated. This needed bat is lacking in the prior art.

SUMMARY OF THE INVENTION

The basic ball bat of the current cutting-edge prior art is a bat consisting of an aluminum frame and a composite shell. The concept of the present invention is similar to that in that there is an aluminum frame, but the present bat differs from the current art because there is a different construction for the exterior shell of the bat, which is especially important in the hitting area of the bat.

The present invention discloses a bat frame which is preferably aluminum. The frame has a handle portion, a taper portion, a barrel portion, and an end cap. An initial shell of some material may be placed over the barrel portion. However, the improvement lies in placing a polymeric material such as polyurethane over the barrel portion. Preferably, the polymeric material is molded over the barrel section.

One advantage of the present invention is the construction of a bat with reduced cost. The current method of construction for a composite shell bat tends to run four (4) to five (5) times the cost of the construction of the present bat with a polymer shell. Thus, the present invention provides a less expensive alternative to the current shell technology. There are several materials that are being used to tweak the design of the present invention. These materials vary in density, compression strength, and flex modulus.

One advantage of the material being used is the material's characteristic to act as a natural vibration dampener. This vibration reduction helps to reduce the sting in any hits on the barrel portion.

Initially, the concept of the present invention was created to apply this shell in a fast pitch market where light weight, reduction in vibration, higher performance with durability, and lower cost were all driving factors for a bat design. However, after initial prototyping, other advantages of this technology were realized for all of the different types of bat designs.

In one embodiment, the bat includes a metal frame having a polymer outer shell formed directly about the barrel portion of the bat. Preferably, the metal frame includes a handle portion, a transition portion and a barrel portion, with the metal frame having an annular step defined therein distally of the handle portion. The polymer outer shell is formed about the metal frame and has a proximal end located adjacent the annular step of the metal frame.

In a second embodiment of the invention, the barrel portion of the bat includes an outer metal shell formed about the barrel portion of the frame, with a polymer outer shell formed about the outer metal shell.

In still a third embodiment of the invention, a polymer outer shell is formed around only an intermediate portion of the metal frame spanning a point of maximum bending stress, so as to provide increased stiffness of the bat at the area of the point of maximum bending stress. The metal frame of the bat extends both proximally and distally from the intermediately located polymer outer shell.

In yet a fourth embodiment of the invention, a polymer outer shell is formed around the entire metal frame.

Methods of manufacturing bats utilizing a polymer shell are also disclosed.

Accordingly, it is an object of the present invention to provide improved baseball and softball bats having selected portions of a metal bat frame reinforced by an exterior polymer shell. Another object of the present invention is the provision of bats having a lighter, yet stronger, construction than conventional bat designs. Still another object of the present invention is the provision of a bat having a metal bat frame which is selectively reinforced at selected portions thereof by a polymer outer shell.

Still another object of the present invention is the provision of bats having improved durability and resistance to denting.

And another object of the present invention is the provision of bats having improved performance characteristics so that they will hit a ball further.

And another object of the present invention is the provision of improved methods for construction of bats having a metal frame with an exterior polymer layer.

Other and further objects, features and advantages of the present invention will be readily apparent to those skilled in the art upon a reading of the following disclosure when taken in conjunction with the accompanying drawings.

BRIEF DESCRIPTION OF THE DRAWINGS

FIG. 6 shows the taper portion and handle portion of the bat having the polymer shell around an intermediate portion.

DETAILED DESCRIPTION OF THE PREFERRED EMBODIMENT

Figure 1:
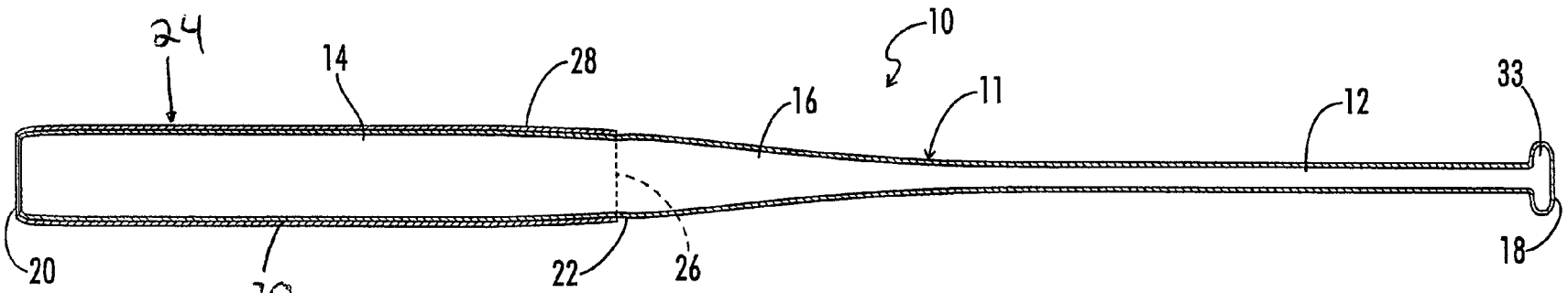
FIG. 1 is a side cutaway view of one embodiment of the bat of the present invention.

The process of constructing this bat is a resin transfer molding (RTM) process. The important characteristics for the material are the density, the compressive strength, the flex modulus, cost, adhesive properties to the frame material, and elongation. The density of the material changes the weight of the finished product and is a consideration in designing the overall bat. The compressive strength is a direct factor in controlling any denting of the aluminum frame which may occur in the transfer of any forces between the polymer shell and the aluminum frame. The flex modulus of the material controls the stiffness and the trampoline effect utilized for the bat. The cost of the material obviously affects overall pricing for the bat and the ability to provide this technology to the market place in the least expensive manner. The elongation of the material directly affects the ability of the polymer shell deform and follow a ding in a bat instead of the unpreferable breaking of the external material which may ruin the ability of the bat to be utilized for further purposes. Another factor to be considered is the adhesion of the material of the polymer shell to the base frame material or, if a multiple layer bat is being constructed, to the shell material placed between he frame and the polymer. The desired material has good adhesion properties for applying it directly to the aluminum frame, although it is also envisioned that an adhesive additive or adhesive layer could be added to improve this characteristic. While the present invention has been designed utilizing an aluminum frame, it is also envisioned that other frame materials may be utilized as is well known in the art.

The present invention is formed by creating a mold designed to form the external shape of the bat although the form may be larger than the finished bat. An aluminum frame is placed within the mold and a temporary end cap is fitted to the end of the aluminum frame much like the cork in a bottle so that material injected into the mold will form itself around the aluminum frame and will not fill the interior of the bat. This material will then be cured and removed from the mold. The mold has been designed to be an oversized mold such that a machine operation may be performed on the polymer shell in order to reduce its thickness to provide a plethora of bats for determining proper thickness of the material for the various different types of materials which are being utilized. Note that the materials will change according to the use of the bat and the desired characteristics of the bat. Also, on one embodiment of the bat, processes may be utilized such that the material is only placed within the impact area or the entire bat may be covered by the polymer shell with varying thicknesses over the entire range of the bat. Another variable which may be controlled to change the bat characteristics, as is well known in the art, is to vary the thickness of the aluminum to maximize the efficiency of the combined system of the polymer shell and the aluminum bat frame. Further improvements for the present invention may include the perforation of the aluminum frame or the use of a net or open shell type of structure to allow for the polymer to at least partially flow into the frame to provide improved adhesion between the polymer shell and the aluminum bat frame.

Referring now the drawings, and particularly to FIG. 1, a bat is shown and generally designated by the numeral 10. The bat 10 includes a frame 11 including a handle portion 12, a barrel portion 14, and a taper portion 16 joining the handle portion 12 and barrel portion 14. The bat frame 11 can be generally described as having a proximal end 18 and a distal end 20. As seen in FIG. 1, at about the location of the junction between the transition portion 16 and the barrel portion 14, there is an annular step 22 that may or may not be formed in the bat frame 11. The annular step 22 can be described as being located distally of the handle portion 12.

A polymer outer shell 24 is formed about the metal frame 11. The outer shell 24 has a near end 26 located adjacent the annular step 22 of the metal frame 11.

In this embodiment, the polymer outer shell 24 terminates distally of the handle portion 12 so that the handle portion 12 is preferably not covered by the outer shell 24.

As seen in FIG. 1, an exterior surface 28 of the polymer outer shell 24 and an exterior surface 30 of the metal frame just proximal of the annular step 22 substantially align to define a smooth outer profile of the bat 10 in the area of the annular step 22.

The distal end 20 of the bat 10 is preferably closed by a conventional end plug (not shown).

A knob 33 is attached, typically by welding, to the proximal end 18 of the bat frame 11.

Figure 2:
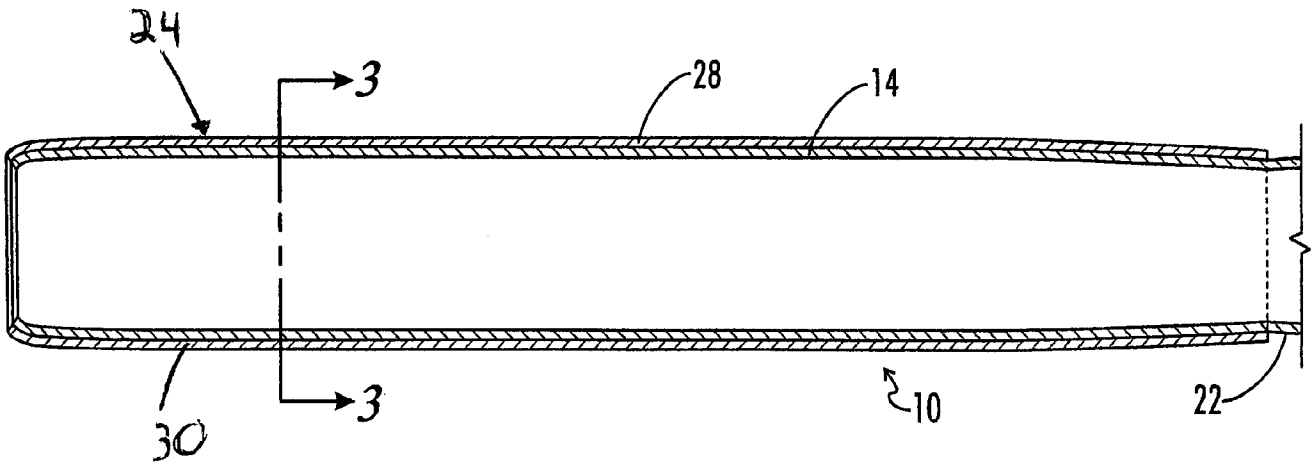
FIG. 2 is a cutaway view of the hitting area of the bat shown in FIG. 1.

FIG. 2 is an enlarged cross-sectional view of a segment of the barrel portion 14 of the bat 10, and shows the manner of construction of the polymer outer shell 24.

In the embodiments of FIGS. 1 and 2, the polymer outer shell 24 is formed directly on and bonded to the barrel portion 14 of the bat frame 11.

The outer shell 24 is preferably formed of a polymer molded directly onto the barrel portion 14. The polymer is then allowed to harden to form a hardened outer shell or outer layer 24 about the metal bat frame 11. Suitable material for forming the polymer shell can include two-part epoxy resin with various rubber materials added for greater impact resistance although any other conventional constructions of polymer materials may be utilized. In this manner, a bat is provided which can have a much thinner metal barrel portion 14 than would a traditional bat, thus providing a lighter bat, which provides the necessary additional strength via the polymer exterior shell 24.

For example, a satisfactory bat like that illustrated in FIGS. 1 and 2 having the polymer outer layer placed directly upon the barrel portion 14 of the bat frame 11, and wherein the bat frame 11 is constructed of a conventional aluminum material such as 7055 aluminum alloy, the metal barrel portion would have a wall thickness in the range of 0.040 to 0.125 inches, in the polymer outer shell 24 will have a wall thickness in the range of 0.020 to 0.100 inches.

With this construction wherein the barrel portion of the bat is surrounded by a polymer outer shell, the outer shell reduces denting of the barrel portion of the bat when used to strike a ball.

Figure 4:
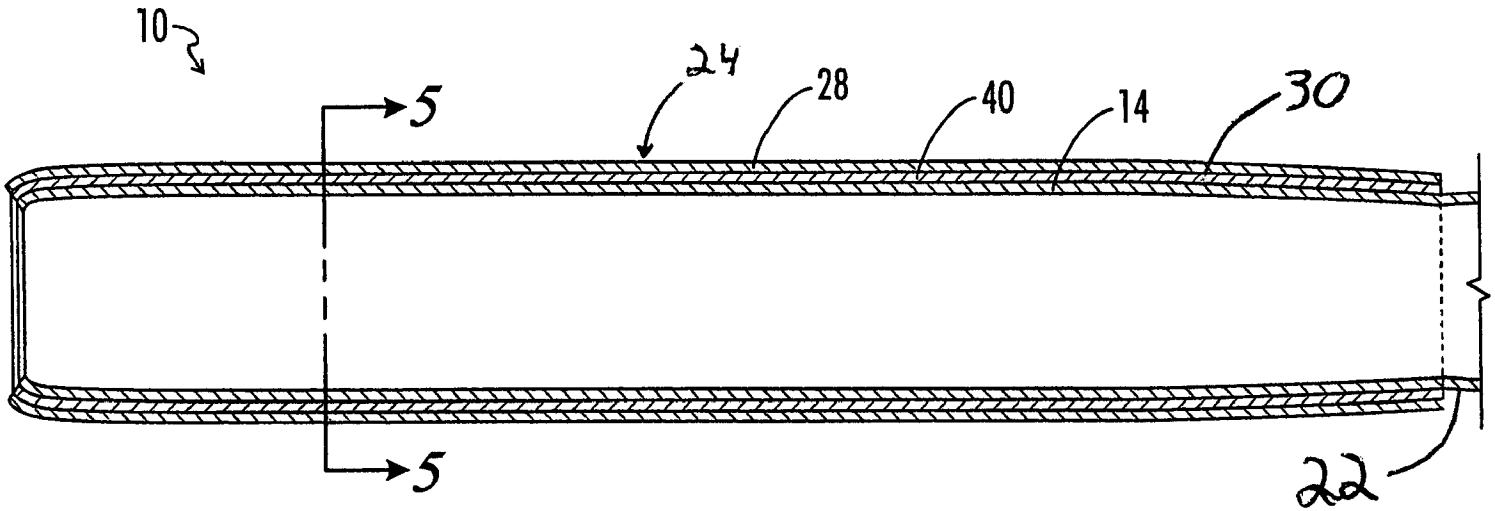
FIG. 4 is a cutaway view of the hitting portion of the embodiment of the bat having an intermediate shell.
Figure 5:
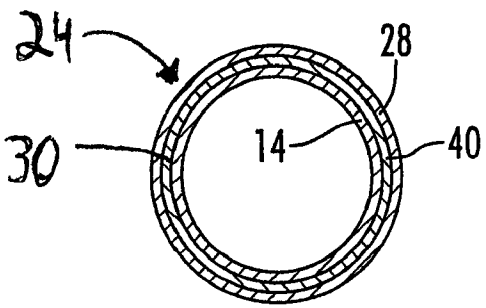
FIG. 5 is an end cutaway view of along the line 5—5 of FIG. 4.

Turning now to FIGS. 4 and 5, a second embodiment of the invention is illustrated. In this embodiment, the barrel portion 14 of the metal bat frame 11 has received thereabout an outer metal sleeve 40 which is constructed in a manner substantially like that of Pitsenberger U.S. Pat. No. 6,053,828, the details of which are incorporated herein by reference. This external metal sleeve 40 covers the barrel portion 14 of the bat and terminates adjacent the annular step 22 so that it is substantially co-extensive with the outer polymer shell 24 seen in FIG. 1. In the embodiment of FIGS. 4 and 5, the outer polymer shell 24 is in fact formed on the outer metal shell 40.

Figure 3:
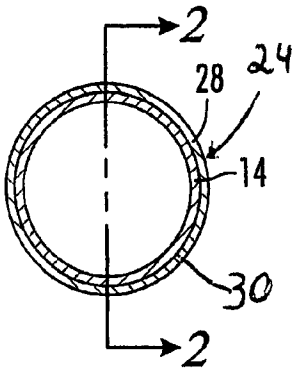
FIG. 3 is an end cutaway view along line 3—3 of FIG. 2.

Thus, after formation of the outer metal shell 40 about the metal bat frame 11 in a manner like that described in U.S. Pat. No. 6,053,828, the polymer outer shell 24 is formed upon the outer metal shell 40 in a manner like that just described with regard to the embodiment of FIGS. 1–3.

With the embodiment of FIGS. 4 and 5, the outer metal shell 40 may be thinner than the outer shell of the Pitsenberger application, and additional reinforcement is provided by the exterior polymer layer 24.

With the embodiment of FIGS. 4 and 5, the dimensions of the metal bat frame 11, the outer metal shell 40 and polymer outer shell 24, and the dimensions of the annular step 22, are preferably chosen so that the exterior surface of the polymer outer shell 24 aligns with the exterior surface of the transition portion 16 of the bat to form a substantially smooth and continuous exterior bat surface across the annular step 22.

More generally, a bat constructed as shown in FIGS. 4 and 5 can be described as having an aluminum bat frame 11 and an aluminum metal outer shell 40, each of which has a wall thickness in the range of 0.030 to 0.060 inches. The bat has a polymer outer shell 24 having a wall thickness in the range of 0.020 to 0.0100 inches.

Figure 6:
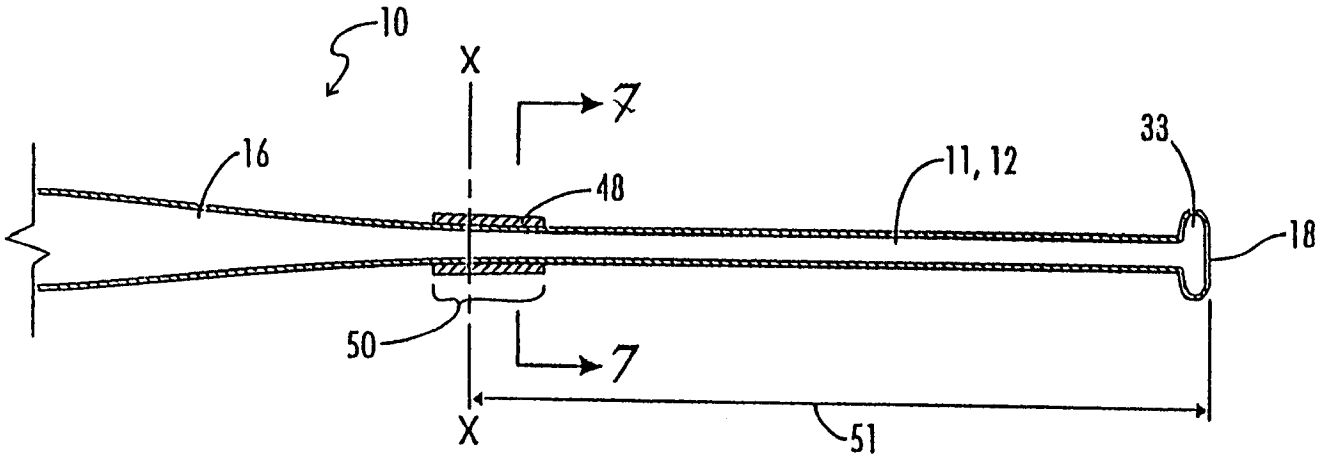
FIG. 6 shows a partial cutaway view of one embodiment of the bat.
Figure 7:
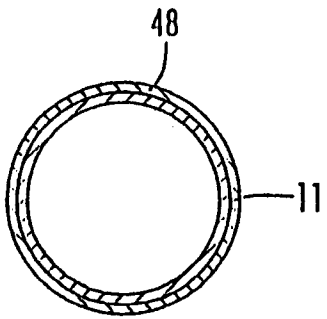
FIG. 7 is a cutaway view of along the line 7—7 of FIG. 6.

FIGS. 6 and 7 illustrate a third embodiment of the invention wherein a polymer outer shell 48 is formed only about an intermediate portion 50 of the metal frame 11.

It will be understood that for any given design of a bat, the bat frame will have a point along its length which is subjected to a maximum bending stress when the bat is used to strike a ball. For example, the bat shown in FIG. 6 may have a point of maximum bending stress along the line x-x. For example, for a typical aluminum bat construction, the point of maximum bending stress x-x would be located a distance 51 from the proximal end 18 of the bat, which distance would typically be approximately 11 inches and would place the point of maximum bending stress x-x in the distal part of the handle portion 12 of the bat frame 11.

The present invention also envisions the selective strengthening of a metal bat by the placement of a polymer outer shell 48 only around an intermediate portion 50 of the bat frame which spans the point x-x of maximum bending stress, so as to provide increased stiffness of the bat in the area of maximum bending stress.

With reference to FIG. 7, the outer shell 48 will preferably be formed of a polymer material to form a hardened outer layer or shell 48.

Again, such a construction can allow a given bat to be made of a thinner wall thickness metal material than would a traditional metal bat. One specific example of such a bat would have an aluminum bat frame 11 having a wall thickness in the area x-x of approximately 0.085 inches, reinforced by a polymer outer layer shell 48 having a wall thickness of 0.030 inches. More generally, such a bat can be described as an aluminum metal bat having a wall thickness at point x-x or in the intermediate portion 50 in the range of 0.050 to 0.100 inches, and having a polymer outer shell 48 with a wall thickness in the range of 0.020 to 0.100 inches.

With this construction, the outer shell 48 is formed only about the intermediate portion 50 of the bat frame 11 so that the bat frame 11 extends both distally and proximally out of the outer shell 48. In this construction, the primary purpose of the polymer outer layer 48 is to strengthen the bat in its zone of maximum bending stress.

Figure 8:
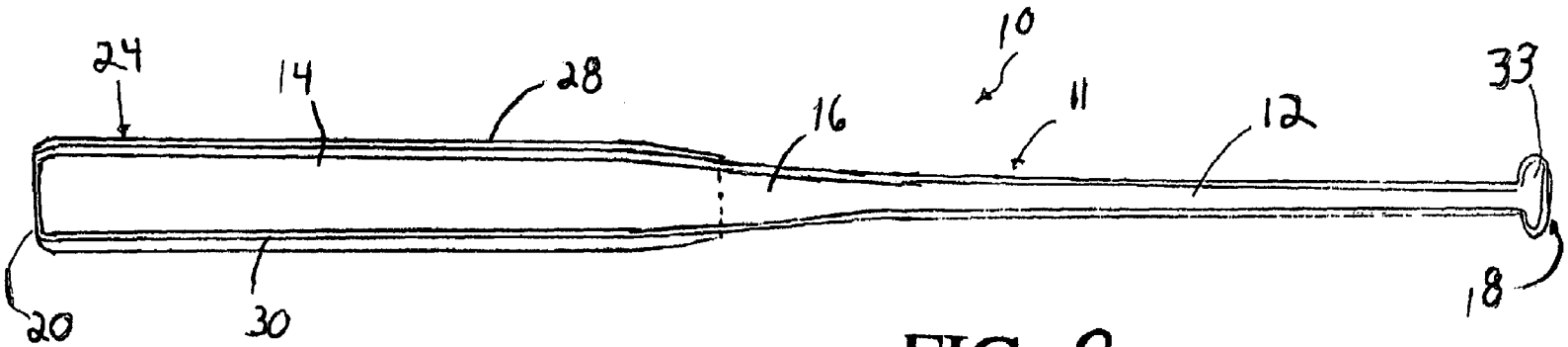
FIG. 8 is a side cutaway view of an alternate embodiment of the bat of the present invention shown with the polymer shell covering the frame in the taper and barrel portions.

As seen in FIG. 8 an alternate embodiment of the bat 10 includes a polymer outer shell 24 covering the frame 11.

Specifically, in this embodiment the polymer outer shell 24 covers the transition portion 16 and barrel portion 14.

Figure 9:
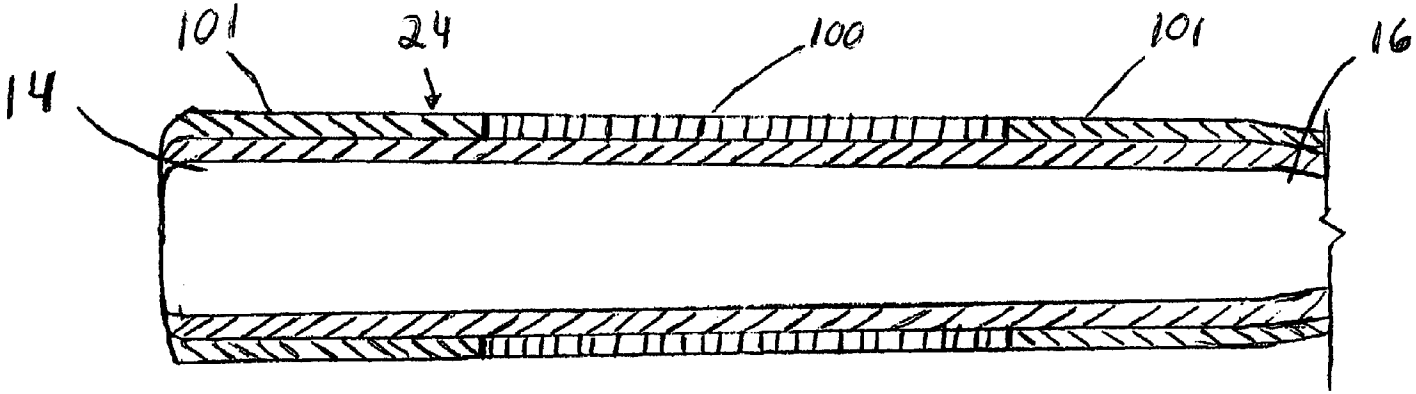
FIG. 9 is a partial side cutaway view showing an embodiment of the invention with varying strengths of polymer in along the length of the frame.
Figure 10:
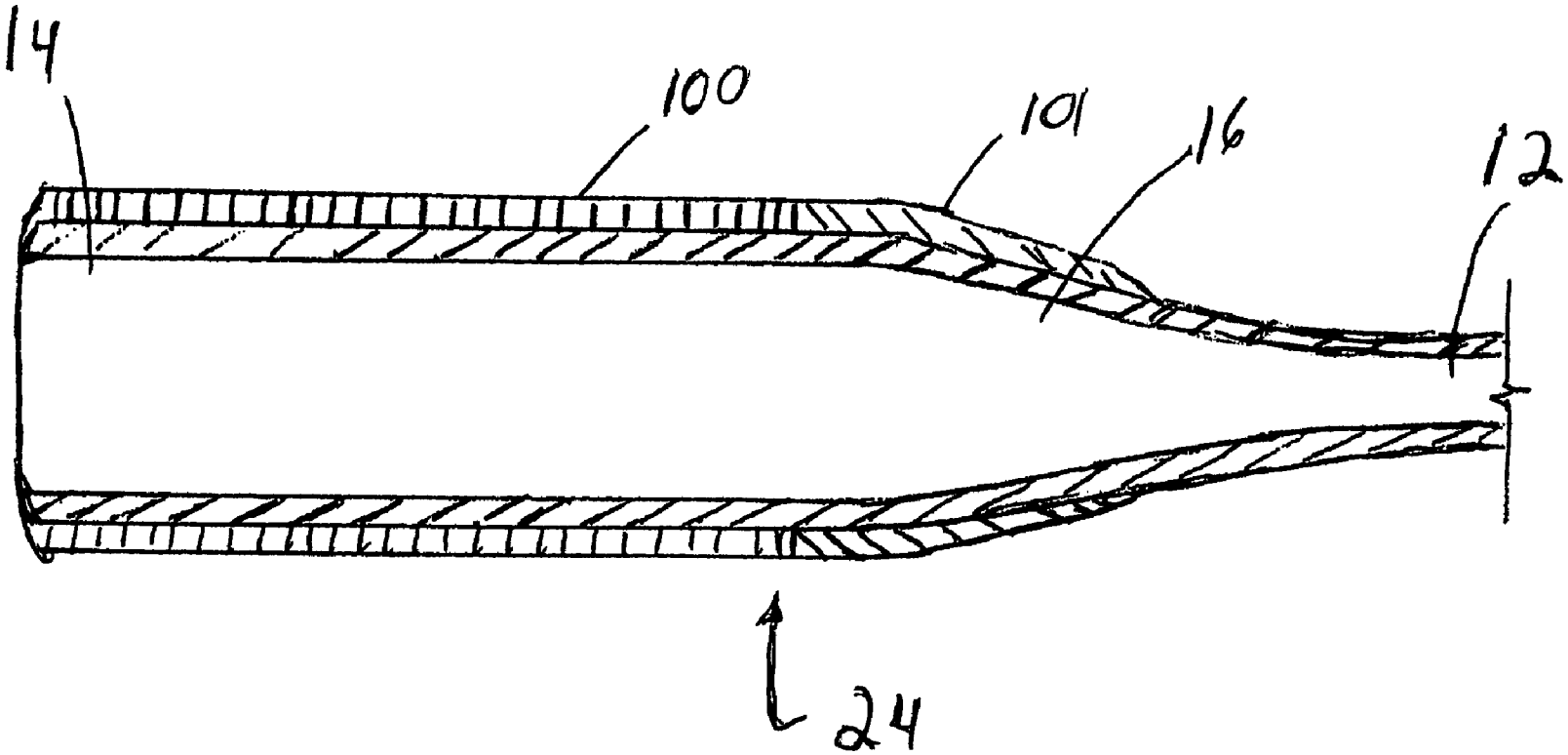
FIG. 10 is a partial side cutaway view showing an alternate embodiment of the invention with varying strengths of polymer in along the length of the frame.

As seen in FIG. 9, an alternate embodiment of the bat 10 includes varying strengths of polymer in along the length of the frame. For example, the polymer shell 24 can include a first polymer 100 positioned near the center of the barrel portion 14. A second polymer 101 can be positioned on either side of the first polymer 100. Alternately, the first polymer 100 and second polymer 101 of the polymer outer shell 24 can varying along the length of the frame 11 as exampled in FIG. 10.

The selective use of strategically positioned polymer outer layers on a metal bat provides a number of advantages over bats constructed solely of metal. Using polymer materials allows the designer more flexibility in the design of the bat. This design flexibility covers virtually all parameters that add value to a bat, including performance, durability and weight. More specifically, polymer materials allow the bat to be designed for varying stiffness at desired locations, weight savings for either lighter weight or a variety of weight distributions, and strength increases for durability gains.

Additional alternative embodiments for the bat are also provided. For example, one embodiment of this invention pertains to a bat 10 with an aluminum frame 11, aluminum shell 40, and a polymer shell 24 outside of the aluminum shell 40. The aluminum shell 40 and polymer shell 24 are in the barrel 14 and slightly in the taper section 16 of the bat 10. The remaining taper section 16 and handle section 12 would consist of only aluminum. The aluminum could be substituted with MMC, Foam, Wood, Plastic, Titanium, Steel, or any other solid structure that will maintain a bat shape.

The polymers could be either thermosets or thermoplastics. Examples of Thermosets would be Epoxy, Polyester, and Polyurethane. Examples of thermoplastics would be ABS, Nylon, Polyether, and Polypropylene. The preferred embodiment uses a two part polyurethane system which contains an aromatic isocyanate prepolymer based upon a polyether polypol for the A component. The B side contains a blend of polyether polyois and hindered amine curing agents.

Many processes could be used for making the polymer sleeve such as hand lay up, Resin transfer molding (RTM), Vacuum Bagging, and Autoclave.

An example of such a bat 10 is as follows. One would form a bat 10 consisting of an aluminum frame 11 and aluminum shell 40. The bat 10 would be put into a mold and epoxy would be injected into the mold using an RTM process. The polymer shell 24 would then be cured and undergo various finishing operations for cleanup and cosmetics.

This bat 10 example takes advantage of the strength, stiffness, and light weight of polymers. The bat 10 will be lighter allowing thinner aluminum as compared to similar styles. The barrel 14 will be stronger leading to a longer durability as compared to similar styles.

A second embodiment of this invention pertains to a bat 10 with an aluminum frame 11 and a polymer shell 24 outside of the aluminum frame 11. The polymer shell 24 is in the barrel 14 and slightly in the taper section 16 of the bat 10. The remaining taper section 16 and handle section 12 would consist of only aluminum. The aluminum could be substituted with MMC, Foam, Wood, Plastic, Titanium, Steel, or any other solid structure that will maintain a bat 10 shape.

The polymers could be either thermosets or thermoplastics. Examples of Thermosets would be Epoxy, Polyester, and Polyurethane. Examples of thermoplastics would be ABS, Nylon, Polyether, and Polypropylene.

Many processes could be used for making the polymer sleeve such as hand lay up, Resin transfer molding (RTM), Vacuum Bagging, Autoclave, and Filament winding.

An example of such a bat 10 is as follows. One would form a bat 10 consisting of an aluminum frame 11. Epoxy would then be applied to make up the polymer section 24. Various rolling and processing steps would take place to minimize air bubbles in the polymer shell 24. The polymer would then be cured and undergo various finishing operations for cleanup and cosmetics.

The bat 10 will be lighter allowing thinner aluminum as compared to similar styles. The barrel 14 will be stronger leading to a longer durability as compared to similar styles.

A third embodiment of this bat 10 is constructed with an Aluminum frame 11 and aluminum shell 40 on the outside of the aluminum frame 11 in the barrel 14 and portion of the taper 16 only. The polymer 24 would be applied only to the taper 16 section of the bat 10. The barrel 14 and portion of the taper 16 section along with the handle 12 would remain exposed aluminum. The aluminum could be substituted with MMC, Foam, Wood, Plastic, Titanium, Steel, or any other solid structure that will maintain a bat 10 shape.

The polymers could be either thermosets or thermoplastics. Examples of Thermosets would be Epoxy, Polyester, and Polyurethane. Examples of thermoplastics would be ABS, Nylon, Polyether, and Polypropylene. Matrix materials for metal fibers could consist of certain polymers or metals such as Aluminum.

Many processes could be used for making the polymer sleeve 1306 such as hand lay up, Resin transfer molding (RTM), Vacuum Bagging, and Autoclave.

An example of such a bat 10 is as follows. One would form a bat 10 consisting of an aluminum frame 11. Epoxy would then be applied. Various rolling and processing steps would take place to minimize air bubbles in the polymer 24 shell. The polymer 24 would then be cured and undergo various finishing operations for cleanup and cosmetics.

This bat 10 example takes advantage of the stiffness and elasticity of the polymer. The added stiffness could be applied to a section of the bat 10 that would alter the original kick point. Hitters at all levels of play require varying degrees of stiffness due to strength and swing speed. This would lead to a light weight option to add stiffness in a designated area.

A fourth embodiment of this bat 10 is constructed with an Aluminum frame 11, and aluminum shell 40 on the outside of the aluminum frame 11 in the barrel 14 and taper 16. Polymer 24 would be applied to the barrel 14, taper 16 and handle 12 section. The aluminum could be substituted with MMC, Foam, Wood, Plastic, Titanium, Steel, or any other solid structure that will maintain a bat 10 shape.

The polymers could be either thermosets or thermoplastics. Examples of Thermosets would be Epoxy, Polyester, and Polyurethane. Examples of thermoplastics would be ABS, Nylon, Polyether, and Polypropylene. Matrix materials for metal fibers could consist of certain polymers or metals such as Aluminum.

Many processes could be used for making the polymer 24 sleeve such as hand lay up, Resin transfer molding (RTM), Vacuum Bagging, and Autoclave.

An example of such a bat 10 is as follows. One would make a core consisting of a foam barrel 14 and taper 16, and a wood frame 11. Epoxy would then be applied. Various rolling and processing steps would take place to minimize air bubbles in the polymer 24 shell. The polymer 24 would then be cured and undergo various finishing operations for cleanup and cosmetics.

The lightweight properties of the foam, polymer and wood leads to a bat 10 that is much lighter than any pertaining to the same market. The polymer 24 aids in a strong enough bat 10 to withstand the impacts created by an end user. The polymer 24 is also used to create a rigid skin that will keep its shape through normal usage. The foam and wood alone do not maintain the desired shape after usage.

A fifth embodiment of this bat 10 is constructed with an Aluminum frame 11, and aluminum shell 40 on the outside of the aluminum frame 11 in the barrel 14 and may cover a portion of the taper 16 only without covering the handle 12. Polymer 24 would be applied to the barrel 14 section and portion of the taper 16 only. The aluminum could be substituted with MMC, Foam, Wood, Plastic, Titanium, Steel, or any other solid structure that will maintain a bat 10 shape.

The polymers could be either thermosets or thermoplastics. Examples of Thermosets would be Epoxy, Polyester, and Polyurethane. Examples of thermoplastics would be ABS, Nylon, Polyether, and Polypropylene. Matrix materials for metal fibers could consist of certain polymers or metals such as Aluminum.

Many processes could be used for making the polymer 24 sleeve such as hand lay up, Resin transfer molding (RTM), Vacuum Bagging, and Autoclave.

An example of such a bat 10 is as follows. One would form a bat 10 consisting of an aluminum frame Hand aluminum shell 40. The polymer shell would be constructed in such a manner that both ends would be made of a first polymer in the middle of the shell area and a second polymer at the ends of the shell area. The polymers may overlap to create transition areas, or alternatively another design could include multiple layers of different polymers. The bat is constructed by being placed into a mold and epoxy would be injected into the mold using an RTM process. Multiple overlapping layers may be formed through the use of several molds. The polymer 24 would then be cured and undergo various finishing operations for cleanup and cosmetics.

The varying properties of the different polymers would give a hitting portion of the bat 10 with varying stiffness.

A sixth embodiment of this bat 10 is constructed with an Aluminum frame 11 and aluminum shell 40 on the outside of the aluminum frame 11 in the barrel 14 and portion of the taper 16 only. Polymer 24 would be applied to the barrel 14 section and may be applied to a portion of the taper 16 only. The handle 12 is not covered. The aluminum could be substituted with MMC, Foam, Wood, Plastic, Titanium, Steel, or any other solid structure that will maintain a bat 10 shape.

The polymers could be either thermosets or thermoplastics. Examples of Thermosets would be Epoxy, Polyester, and Polyurethane. Examples of thermoplastics would be ABS, Nylon, Polyether, and Polypropylene. Matrix materials for metal fibers could consist of certain polymers or metals such as Aluminum.

Many processes could be used for making the polymer 24 sleeve such as hand lay up, Resin transfer molding (RTM), Vacuum Bagging, and Autoclave.

An example of such a bat 10 is as follows. One would form a bat 10 consisting of an aluminum frame 11 and aluminum shell 40. A first light comparatively weight polymer is molded in the center of the hitting area. The bat 10 would be put into a mold and a comparatively heavy polymer would be injected into the mold using an RTM process. The polymer 24 would then be cured and undergo various finishing operations for cleanup and cosmetics.

The varying weights of the different polymers would give a hitting portion of the bat 10 with varying weight. Similar to perimeter weighting in golf club design, a hitting surface of a bat 10 would be the end result. The heavier polymer would be on both ends of the polymer 10 shell. A lightweight polymer 24 in the main hitting area would lead to lighter hitting area than the surrounding barrel 14 portions giving a more forgiving (bigger sweet spot) hitting area.

As noted in these examples several different types of materials and methods of construction may be used to form any of these bats or variations of them. The materials and methods used in these bats include at least the following materials and any of their equivalents and any of the equivalent methods for creating the frame, taper, and composites for these bats.

A thermoset resin system may be used. Once thermoset is cured, it is a permanent part. This resin can not be remolded or recycled. Examples would be Epoxy, Polyester, and Polyurethane.

Thermoplastic resin system can also be used. A thermoplastic is cured at room temperature. Once it is cured, it can be reheated and reused if desired. Examples would be ABS, Nylon, Polyether, and Polypropylene.

The polymer may be applied using hand lay up. It can be used with any of the resin systems. The resin is brushed on and rolled for complete wet of the area. Depending on the resin system either heat or ambient temperature would cure the part. Different degrees of finishing would be involved to make the part appealing.

Resin transfer matrix can be used with any of the resin systems. The bat is inserted into a mold. Resin would then be pumped into the mold cavity. Depending on the resin system either heat or ambient temperature would cure the part. Different degrees of finishing would be involved to make the part appealing.

A vacuum bag can be used with any of the resin systems. Polymer would then be brushed on and rolled for complete coverage. A bag would then be put over the wet part and hooked up to a vacuum. This will force most of the air out of the finished part. Depending on the resin system either heat or ambient temperature would cure the part. Different degrees of finishing would be involved to make the part appealing.

An autoclave can be used with any of the resin systems. The polymer is brushed on and rolled for complete coverage. A bag would then be put over the wet part and hooked up to the autoclave system. This will create a pressure greater than that of a vacuum. This will force most of the air out of the finished part. Depending on the polymer system either heat or ambient temperature would cure the part. Different degrees of finishing would be involved to make the part appealing.

Several different types of apparatus have been described as being a formed bat including a frame/aluminum shell/polymer shell. This concept is constructed with an Aluminum frame, an aluminum shell, and a polymer shell on the outside of the aluminum shell in the barrel and portion of the taper only. The aluminum could be substituted with aluminum MMC, Foam, Wood, Plastic, Titanium, Steel, or any other solid structure that will maintain a bat shape. This bat would use the polymer to add strength to the barrel section using a less dense structure leading to a lighter bat shell allowing for various design changes.

A frame/polymer shell is also disclosed. This concept is constructed with an Aluminum frame, and a polymer shell on the outside of the aluminum shell in the barrel and portion of the taper only. The aluminum could be substituted with aluminum MMC, Foam, Wood, Plastic, Titanium, Steel, or any other solid structure that will maintain a bat shape. This bat would use the polymer to add strength to the barrel section using a less dense structure leading to a lighter bat shell allowing for various design changes.

A frame/polymer taper is also disclosed. This concept is constructed with an Aluminum frame and aluminum shell on the outside of the aluminum frame in the barrel and portion of the taper only. The aluminum could be substituted with aluminum MMC, Foam, Wood, Plastic, Titanium, Steel, or any other solid structure that will maintain a bat shape. This bat would consist of an aluminum barrel, taper, and handle. Polymer would be applied to the taper section only or the taper and handle section. The polymer reinforcement would be used to alter the stiffness of the bat in that area.

A frame/full polymer coverage bat is also disclosed. This concept is constructed with an aluminum frame, or aluminum frame and aluminum shell on the outside of the aluminum frame in the barrel and portion of the taper only. The aluminum could be substituted with aluminum MMC, Foam, Wood, Plastic, Titanium, Steel, or any other solid structure that will maintain a bat shape. This bat would consist of an aluminum barrel, taper, and handle. Polymer would be applied to the barrel, taper and handle section. The polymer reinforcement would be used to give different sweet spot, stiffness, barrel strength, and decoration in any combination desired.

A polymer barrel is also disclosed. This concept is constructed with an Aluminum frame and polymer shell on the outside of the aluminum frame in the barrel and possibly a portion of the taper only. The aluminum could be substituted with aluminum MMC, Foam, Wood, Plastic, Titanium, Steel, or any other solid structure that will maintain a bat shape. The polymer would be used to change the hitting performance by optimizing the sweet spot of the hitting area. The polymer types would be varied throughout the length of the barrel. For example, heavy polymers could be used at the end of the barrel and end of taper. Light polymers could then be used on the inner barrel where the sweet spot is located. This could give different hit performances and varying degrees of vibration.

Variable weighting is also disclosed. This concept is constructed with an Aluminum frame and polymer shell on the outside of the aluminum frame in the barrel and portion of the taper only. The aluminum could be substituted with aluminum MMC, Foam, Wood, Plastic, Titanium, Steel, or any other solid structure that will maintain a bat shape. Similar to perimeter weighting in golf clubs, the polymer could be made up in such a way that the barrel portion his heavier on either side of the sweet spot, thus increasing the size of the sweet spot.

Variable wall thickness is also disclosed. This concept is constructed with an Aluminum frame and polymer shell on the outside of the aluminum frame in the barrel and portion of the taper only. The aluminum could be substituted with aluminum MMC, Foam, Wood, Plastic, Titanium, Steel, or any other solid structure that will maintain a bat shape. The polymer could be constructed in such a way that the sweet spot is thinner than the rest of the barrel giving more trampoline effect and using the elastic properties of the polymer.

Variable polymer combinations are disclosed. Any of the above could be accomplished by using a single type of polymer or in combinations. For instance, on top of the aluminum may be a first polymer. Over this would be a second layer of a similar or different type polymer. This allows for the use of multiple characteristics of the different layers in combination.

Further advantages may be had through the combination or removal of an additional shell, such as the aluminum shells currently being used, with the different polymer constructions of the present invention.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A bat comprising:

a frame having a handle portion, a taper portion and a barrel portion, the barrel portion including a main hitting area and a surrounding barrel portion;

a fiberless polymeric shell attached to only the barrel portion; and a first polymer covers the main hitting area and a second polymer covers the surrounding barrel portion.

2. The bat of claim 1 wherein the first polymer is a heavy polymer and the second polymer is a light polymer.

3. The bat of claim 1 wherein the polymeric shell is polyurethane.

4. The bat of claim 1 wherein the polymeric shell is non-aerated polyurethane.

5. The bat of claim 1 wherein the polymeric shell is non-expanded polyurethane.

6. The bat of claim 1 wherein the polymeric shell is elastic polyurethane.

7. The bat of claim 1 further comprising an outer shell between the frame and the polymeric shell.

8. The bat of claim 7 wherein the outer shell covers only a main hitting area.

9. The bat of claim 7 wherein the outer shell covers at least a portion of the barrel portion.

10. The bat of claim 7 wherein the polymeric shell covers the outer shell.

11. The bat of claim 7 wherein the outer shell is selected from a group consisting of aluminum, titanium, and maraging steel.

12. The bat of claim 7 wherein the outer shell is metallic.

13. A bat comprising:

a metal frame having a handle, a taper, and a barrel;

a fiberless polymer shell attached to only the taper and the barrel, the barrel portion including a main hitting area and a surrounding barrel portion; and a first polymer covers the main hitting area and a second polymer covers the surrounding barrel portion and the taper.

14. The bat of claim 13 wherein the polymer shell only covers the portion of the taper proximate to the barrel of the frame.

15. The bat of claim 13 wherein the first polymer is a heavy polymer and the second polymer is a light polymer.

16. The bat of claim 13 wherein the first polymer is a light polymer and the second polymer is a heavy polymer.

* * * * *